US005844368A

United States Patent [19]

Okuda et al.

[11] Patent Number: 5,844,368

[45] Date of Patent: Dec. 1, 1998

[54] DRIVING SYSTEM FOR DRIVING LUMINOUS ELEMENTS

[75] Inventors: Yoshiyuki Okuda; Shinichi Ishizuka, both of Turugashima, Japan

[73] Assignee: Pioneer Electronic Corporation, Tokyo, Japan

[21] Appl. No.: 806,457

[22] Filed: Feb. 26, 1997

[30] Foreign Application Priority Data

Feb. 26, 1996 [JP] Japan ..... 8-038393

[51] Int. Cl.[6] ..... G09G 3/10

[52] U.S. Cl. ..... 315/169.3; 315/169.1; 315/169.2; 345/76; 345/77; 345/214

[58] Field of Search ..... 315/169.3, 169.1, 315/169.4, 167, 169.2; 345/42, 76, 84, 95, 204, 214, 63, 77

[56] References Cited

U.S. PATENT DOCUMENTS

| | | | |
|---|---|---|---|
| 4,975,691 | 12/1990 | Lee | 315/169.3 X |
| 5,081,400 | 1/1992 | Weber et al. | 315/169.4 |
| 5,206,631 | 4/1993 | Yamamoto et al. | 315/169.3 X |
| 5,369,338 | 11/1994 | Kim | 315/169.4 |
| 5,446,344 | 8/1995 | Kanazawa | 315/169.4 |

*Primary Examiner*—Robert J. Pascal
*Assistant Examiner*—Haissa Philogene
*Attorney, Agent, or Firm*—Morgan, Lewis & Bockius LLP

[57] ABSTRACT

A driving system and driving unit for driving luminous elements has a fast build-up speed from the application of voltage to the point of light emission, thereby allowing fast scanning, as well as the capacity for miniaturization of driving sources. The driving system for driving luminous elements includes a plurality of intersecting anode and cathode lines arranged in a matrix, the anode lines being one of scan lines and drive lines, and the cathode lines being the other of scan lines and drive lines; a plurality of luminous elements, each of the luminous elements being coupled to one of the scan lines and one of the drive lines at a point where the scan and drive lines intersect; and control circuitry for causing at least one of the luminous elements to emit light by executing scanning of at least one of the scan lines and, during a predetermined period of the scanning, by coupling a driving source to at least one of the drive lines in synchronism with the scanning, the control circuitry resetting the scan lines before switching to a subsequent scan line by coupling each of the scan lines to a same reset voltage potential.

18 Claims, 14 Drawing Sheets

DRIVING SYSTEM FOR DRIVING LUMINOUS ELEMENTS

BACKGROUND OF THE INVENTION

1. Field of the Invention

The present invention relates to a driving system for causing luminous elements, such as organic EL (electroluminescense) elements, to emit light.

2. Description of Related Art

FIG. 13 shows a conventional driving system for driving luminous elements. The driving system shown in FIG. 13 is known as a simple matrix driving system in which anode lines $A_1$ through $A_m$ and cathode lines $B_1$ through $B_n$ are disposed in a matrix (grid). In the driving system of FIG. 13, luminous elements $E_{1,1}$ through $E_{m,n}$ are connected at each intersection of the anode lines and cathode lines. The driving system causes the luminous element at an arbitrary intersection to emit light by selecting and scanning one of the anode lines and the cathode lines sequentially at fixed time intervals and by driving the other of the anode and cathode lines by current sources $\mathbf{52}_1$ through $\mathbf{52}_m$, i.e., driving sources, in synchronism with the scan.

Thus, there are two systems for driving luminous elements by means of the driving sources: (1) a system of scanning the cathode lines and driving the anode lines and (2) a system of scanning the anode lines and driving the cathode lines. FIG. 13 shows the former case of scanning the cathode lines and driving the anode lines.

In FIG. 13, a cathode line scanning circuit 51 is connected to the cathode lines $B_1$ through $B_n$ and an anode line driving circuit 52 comprising the current sources $\mathbf{52}_1$ through $\mathbf{52}_m$ is connected to the anode lines $A_1$ through $A_m$. The cathode line scanning circuit 51 applies a ground potential (0 V) sequentially to the cathode lines $B_1$ through $B_n$ by scanning these lines while switching switches $\mathbf{53}_1$ through $\mathbf{53}_n$ to the side of a ground terminal at fixed time intervals. The anode line driving circuit 52 connects the current sources $\mathbf{52}_1$ through $\mathbf{52}_m$ with the anode lines $A_1$ through $A_m$ by controlling ON/OFF of switches $\mathbf{54}_1$ through $\mathbf{54}_m$ in synchronism with the scanning of the switches of the cathode line scanning circuit 51 to supply driving current to the luminous element at the desired intersection.

When the luminous elements $E_{2,1}$ and $E_{3,1}$ are to emit light, for example, the switches $\mathbf{54}_2$ and $\mathbf{54}_3$ of the anode line driving circuit 52 are switched to the side of the current sources to connect the anode lines $A_2$ and $A_3$ with the current sources $\mathbf{52}_2$ and $\mathbf{52}_3$. At the same time the switch $\mathbf{53}_1$ of the cathode line scanning circuit 51 is switched to the ground side so that ground potential is applied to the first anode line $B_1$, as shown in FIG. 13. The luminous elements are controlled so that the luminous element at an arbitrary position emits light and so that each luminous element appears to emit light concurrently by quickly repeating such scan and drive.

A reverse bias voltage $V_{cc}$, which is equal to the source voltage, is applied to each of the cathode lines $B_2$ through $B_n$. The reverse bias voltage $V_{oc}$ is not applied to the cathode line $B_1$ being scanned in order to prevent erroneous emission. It should be noted that although the current sources $\mathbf{52}_1$ through $\mathbf{52}_m$ are used as the driving sources in FIG. 13, the same effect may be realized also by using voltage sources.

Each of the luminous elements $E_{1,1}$ through $E_{m,n}$ connected at each intersection may be represented by a luminous element E having a diode characteristic and a parasitic capacitor C connected in parallel, as shown by the equivalent circuit in FIG. 14. However, the prior art driving system described above has had problems due to the parasitic capacitor C within the equivalent circuit. The problems are described as the following.

FIGS. 15A and 15B show each of the luminous elements $E_{1,1}$ through $E_{1,n}$ using only the parasitic capacitors C described above by excerpting the part of the luminous elements $E_{1,1}$ through $E_{1,n}$ connected to the anode line $A_1$ in FIG. 13. When the cathode line $B_1$ is scanned and the anode line $A_1$ is not driven, the parasitic capacitors $C_{1,2}$ through $C_{1,n}$ of the other luminous elements $E_{1,2}$ through $E_{1,n}$ (except the parasitic capacitor $C_{1,1}$ of the luminous element $E_{1,1}$ connected to the cathode line $B_1$ currently being scanned), are charged by the reverse bias voltage Vcc applied to each of the cathode lines $B_1$ through $B_n$, in the direction as shown in FIG. 15A.

Next, when the scanning position is shifted from the cathode line $B_1$ to the next cathode line $B_2$ and the anode line $A_1$ is driven in order to cause the luminous element $E_{1,2}$ to emit light, for example, the state of the circuit is shown in FIG. 15B. Thus, not only is the parasitic capacitor $C_{1,2}$ of the luminous element $E_{1,2}$, which emits light changed, but the parasitic capacitors $C_{1,1}$ and $C_{1,3}$ through $C_{1,n}$ of the luminous elements $E_{1,1}$ and $E_{1,3}$ through $E_{1,n}$ connected to the other cathode lines $B_1$ and $B_3$ through $B_n$, also are charged because currents flow into the capacitors in the direction as indicated by arrows.

In general, luminous elements cannot emit light normally unless a voltage between both ends thereof builds up to a level which exceeds a specified value. In the prior art driving system discussed above, not only is the parasitic capacitor $C_{1,2}$ changed when $E_{1,2}$ is to emit light, but the parasitic capacitors $C_{1,3}$ through $C_{1,n}$ of the other luminous elements $E_{1,3}$ through $E_{1,n}$ are charged as well. As a result, the end-to-end voltage of the luminous element $E_{1,2}$ connected to the cathode line $B_2$ cannot build up above the specified value until the charging of all of these parasitic capacitors of the luminous elements is completed.

Accordingly, the prior art driving system has had a problem in that the build up speed until emission is slow. Also no fast scan can be attained due to the parasitic capacitors described above. Further, because the parasitic capacitors of all of the luminous elements connected to the anode line have to be charged, a current capacity of the driving source for driving the luminous elements connected to each anode line must be large, thus leaving room for consideration from the aspect of miniaturization of the circuit.

The more the number of the luminous elements, the more significant the aforementioned problem becomes. When organic ELs are used as the luminous elements, this problem becomes remarkable because the organic EL has a large parasitic capacitor C surface-emission.

SUMMARY OF THE INVENTION

Accordingly, the present invention is directed to a driving system for driving luminous elements that substantially obviates one or more of the problems due to limitations and disadvantages of the related art.

It is an object of the present invention to solve the aforementioned problems by providing a luminous element driving system and a driving unit whose build up speed from the start of supply of driving current to emission is fast, thus enabling fast scanning. Another object is to provide a luminous element driving system and driving unit which allow the driving source to be miniaturized.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the driving system for driving luminous elements includes a plurality of intersecting anode and cathode lines arranged in a matrix, the anode lines being one of scan lines and drive lines, and the cathode lines being the other of scan lines and drive lines; a plurality of luminous elements, each of the luminous elements being coupled to one of the scan lines and one of the drive lines at a point where the scan and drive lines intersect; and control circuitry for causing at least one of the luminous elements to emit light by executing scanning of at least one of the scan lines and, during a predetermined period of the scanning, by coupling a driving source to at least one of the drive lines in synchronism with the scanning, the control circuitry resetting the scan lines before switching to a subsequent scan line by coupling each of the scan lines to a same reset voltage potential.

In the driving system, the potential of the reset voltage source is preferably a ground potential. Nonetheless, the potential of the reset voltage source may be also a supply potential. Moreover, in the driving system of the present invention, all of the driving sources on the drive side may be eliminated if so desired.

By the construction described above, when the scanning position is switched to the next scan line after resetting all the scan lines, the parasitic capacitor of the luminous element that is to emit light is charged by the driving source via the drive line and by the reverse bias voltage of the scan lines at the same time through the parasitic capacitors of the other luminous elements which are not emitting light. Therefore, because an end-to-end voltage of the luminous element that is to emit light builds up to a voltage which allows the instant emission of light, the luminous element can emit light instantly.

Further, even if the driving sources on the drive line side are eliminated, the parasitic capacitor of the luminous element that is to emit light is charged by the reverse bias voltage of the scan line through the parasitic capacitors of the other luminous elements which are not emitting light and, as a result, will emit light for a short time. Accordingly, the lighting of the luminous elements may be controlled just as if such elements emit light continuously, even if the driving sources on the drive line side are eliminated by scanning with a period shorter than the emission time.

The above and other features and advantages of the present invention will become more apparent in the following description and the accompanying drawings in which like numerals refer to like parts.

It is to be understood that both the foregoing general description and the following detailed description are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this specification, illustrate principles of the invention. In the drawings:

FIG. 10 illustrates a third step of the third driving system of the present invention;

DESCRIPTION OF PREFERRED EMBODIMENTS

Figure 1:
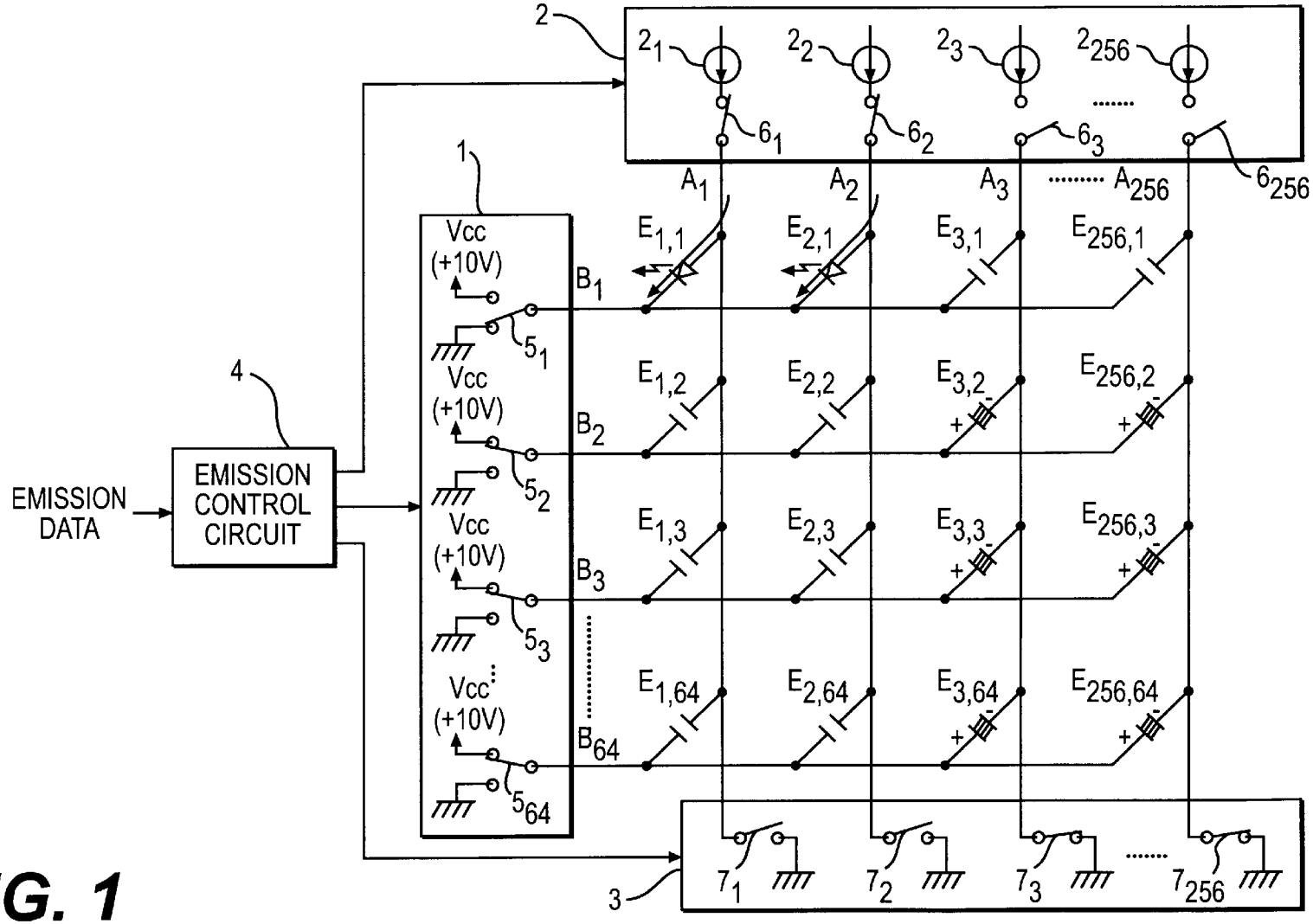
FIG. 1 illustrates a first step of a first driving system of the present invention.

Reference will now be made in detail to the preferred embodiments of the present invention, examples of which are illustrated in the accompanying drawings.

FIGS. 1 through 4 show a first driving system of the present invention. This first driving system corresponds to a case in which all cathode lines and all anode lines are reset by dropping their voltage to a ground potential (0 V) once in a shifting scan to the next cathode line.

In FIGS. 1 through 4, the system comprises anode lines $A_1$ through $A_{256}$, cathode lines $B_1$ through $B_{64}$, luminous elements $E_{1,1}$ through $E_{256,64}$, a cathode line scanning circuit l, an anode line driving circuit 2, an anode line resetting circuit 3, and an emission control circuit 4. The cathode line scanning circuit 1 comprises scanning switches $\mathbf{5}_1$ through $\mathbf{5}_{64}$ for sequentially scanning each of the cathode lines $B_1$ through $B_{64}$. One terminal of each of the scanning switches $\mathbf{5}_1$ through $\mathbf{5}_{64}$ is connected to a reverse bias voltage source whose voltage is equal to the source voltage $V_{cc}$ (e.g., 10 V) and the other terminal is connected to the ground voltage (0 V).

The anode line driving circuit 2 comprises current sources $\mathbf{2}_1$ through $\mathbf{2}_{256}$, i.e., driving sources, and driving switches $\mathbf{6}_1$ through $\mathbf{6}_{256}$ for selecting each of the anode lines $A_1$ through $A_{256}$. The anode line driving circuit 2 connects the current sources $\mathbf{2}_1$ through $\mathbf{2}_{256}$ to drive the luminous elements at a pertinent anode line by turning on an arbitrary driving switch.

The anode line resetting circuit 3 comprises shunt switches $\mathbf{7}_1$ through $\mathbf{7}_{256}$ for resetting the anode lines $A_1$ through $A_{256}$ to the ground potential (0 V).

It is noted that ON/OFF control of scanning switches $5_1$ through $5_{64}$, driving switches $6_1$ through $6_{256}$ and shunt switches $7_1$ through $7_{256}$, is controlled by the emission control circuit 4.

The operations for emitting light by means of the first driving system will be explained with reference to FIGS. 1 through 4. The operations described below will be explained by referring to an example when luminous elements $E_{1,1}$ and $E_{1,2}$ are caused to emit light by scanning the cathode line $B_1$ and, then, the luminous elements $E_{2,2}$ and $E_{3,2}$, are caused to emit light by shifting the scan to the cathode line $B_2$. Further, in order to facilitate this description, the luminous elements emitting light are indicated by the diode symbol and the other luminous elements that are not emitting light are indicated by the capacitor symbol. The reverse bias voltage $V_{cc}$ applied to the cathode lines $B_1$ through $B_{64}$ is set at 10 V, which is equal to the source voltage of the system.

In FIG. 1, at first the scanning switch $5_1$ is switched to 0 V and the cathode line $B_1$ is scanned. The reverse bias voltage of 10 V is applied to the other cathode lines $B_2$ through $B_{64}$ via the scanning switches $5_2$ through $5_{64}$. Further, the current sources $2_1$ and $2_2$ are connected to the anode lines $A_1$ and $A_2$ via the driving switches $6_1$ and $6_2$. Still further, 0 V is applied to the other anode lines $A_3$ through $A_{256}$ via the shunt switches $7_3$ through $7_{256}$.

Accordingly, FIG. 1 illustrates that only the luminous elements $E_{1,1}$ and $E_{2,1}$ emit light because only these elements are biased in the forward direction such that driving currents flow into these elements from the current sources $2_1$ and $2_2$, as indicated by arrows in the figure. In the state of FIG. 1, the luminous elements indicated by a hatched capacitor are being charged, respectively, in the direction of the polarity shown in the figure. Then, the following reset control is carried out in shifting the scan so that a state of emission in which the luminous elements $E_{2,2}$ and $E_{3,2}$ emit light, as shown in FIG. 4, is brought about from the state of emission in FIG. 1.

Figure 2:
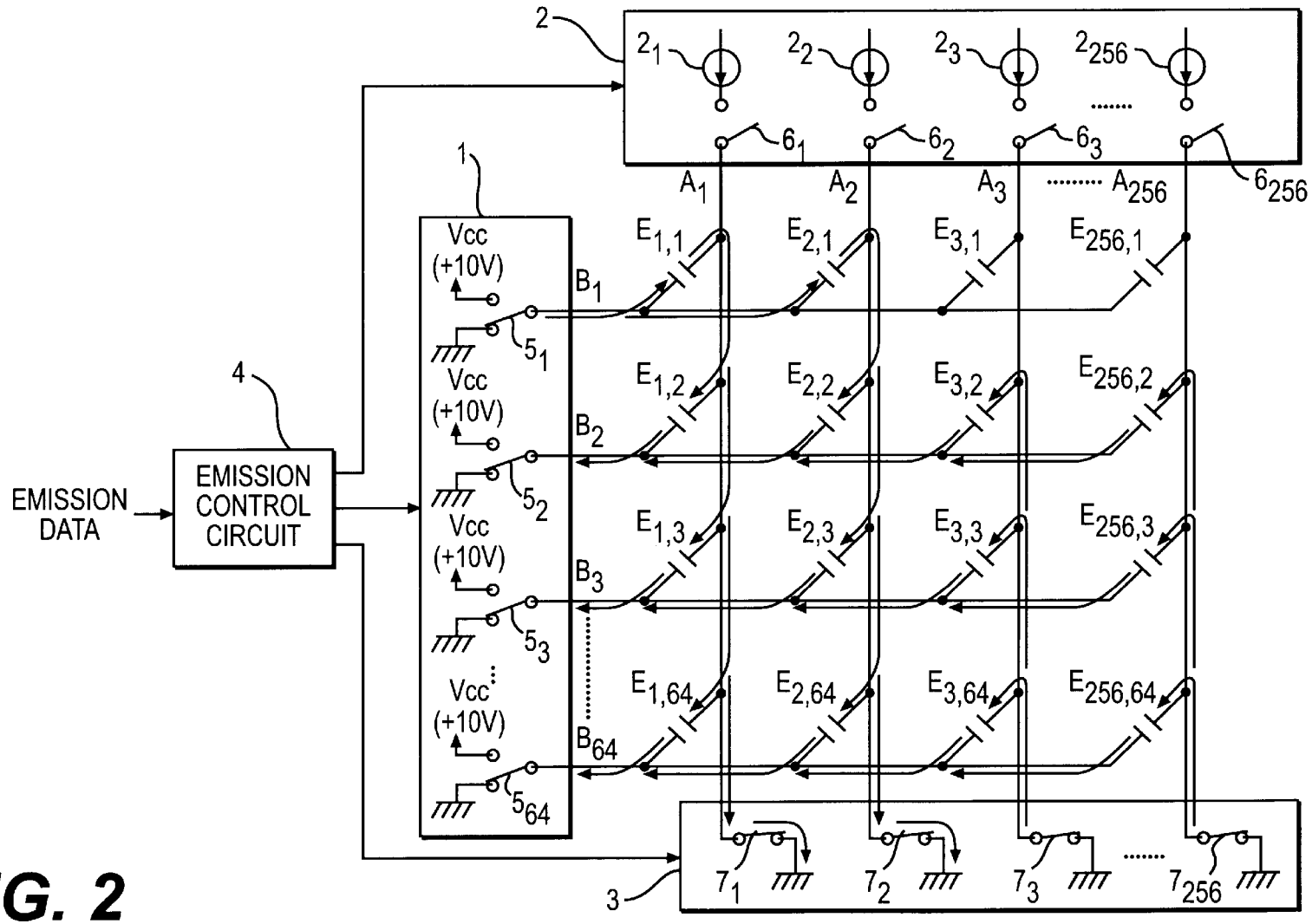
FIG. 2 illustrates a second step of the first driving system of the present invention.
Figure 3:
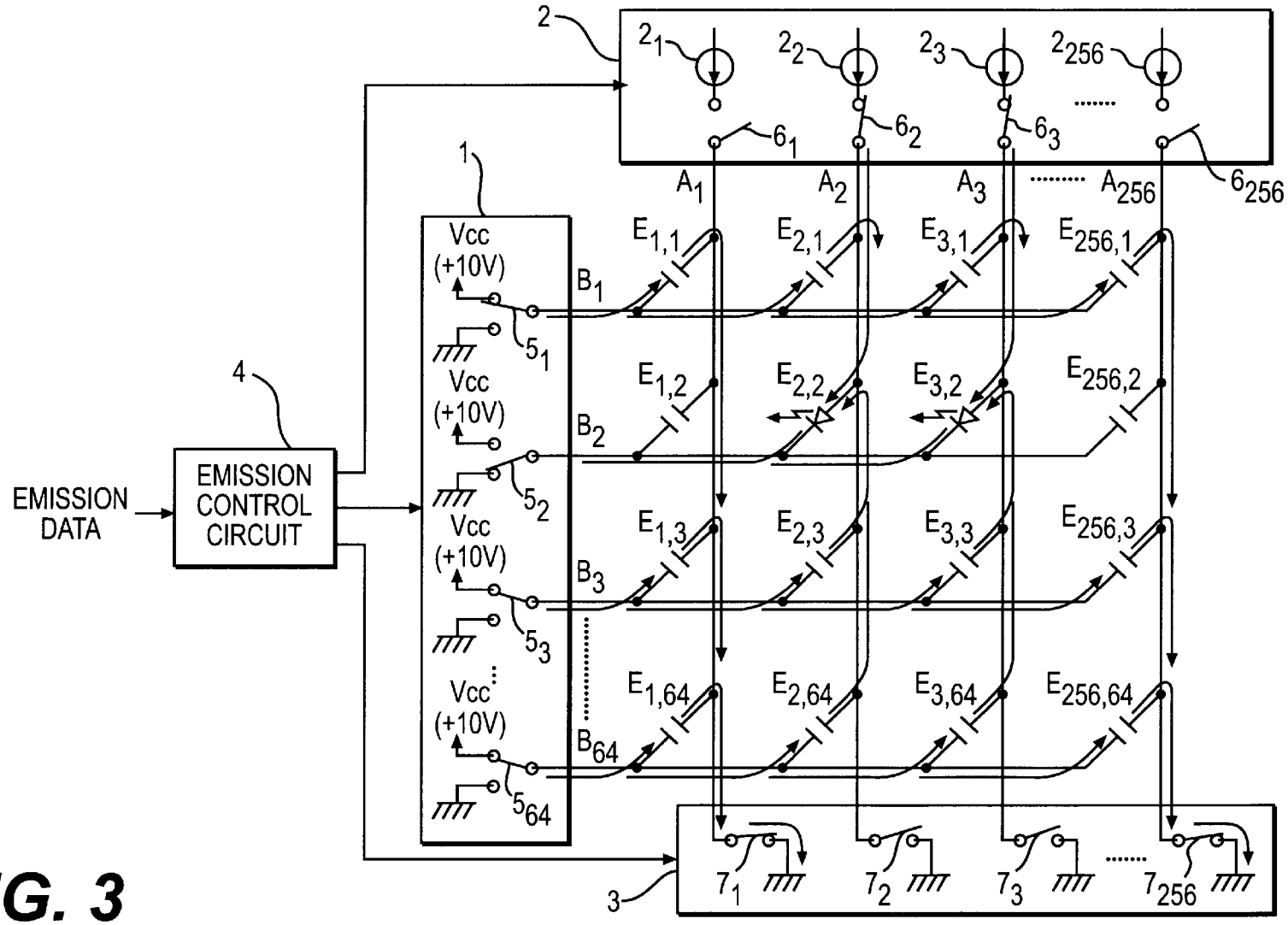
FIG. 3 illustrates a third step of the first driving system of the present invention.
Figure 4:
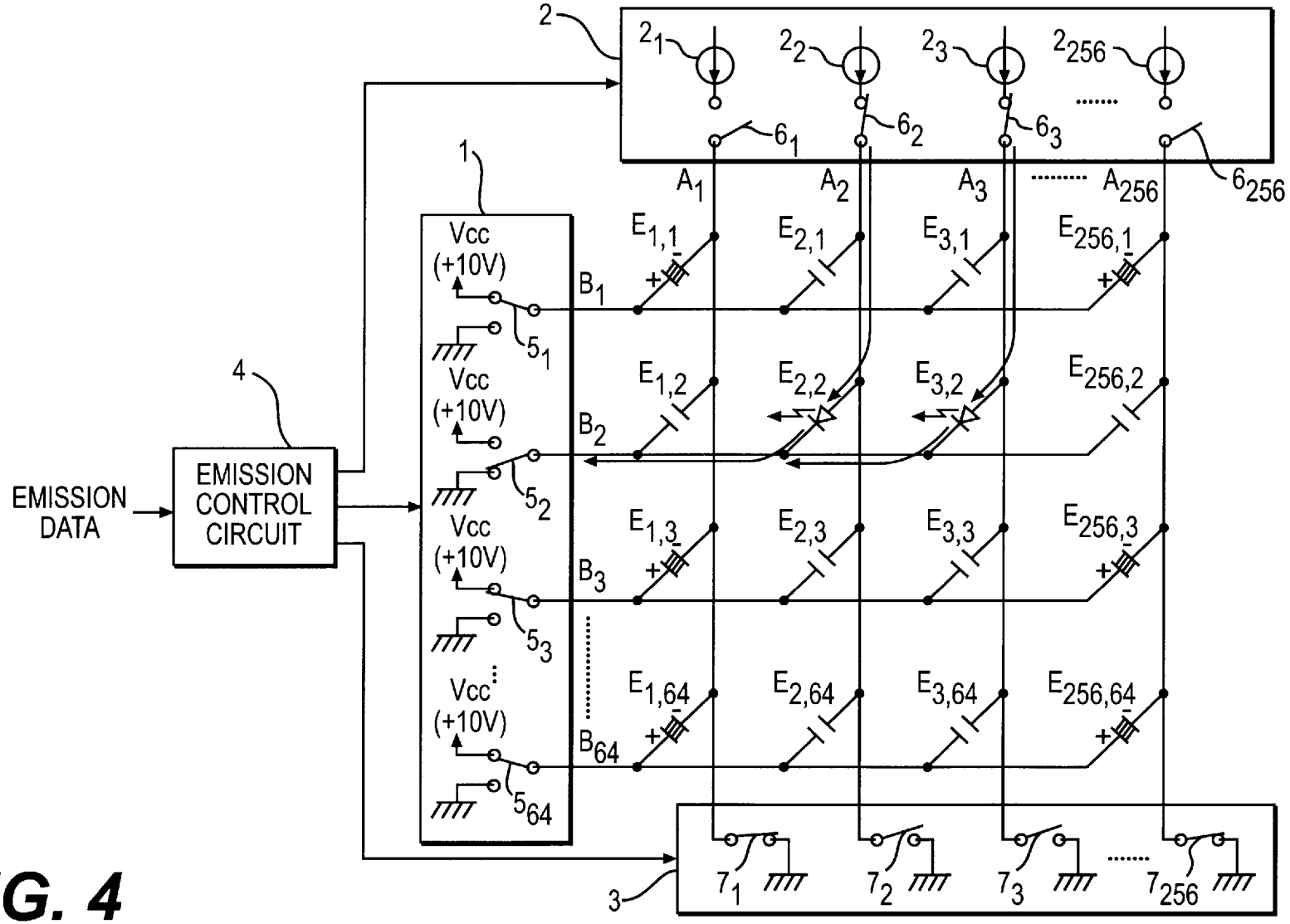
FIG. 4 illustrates a fourth step of the first driving system of the present invention.

That is, before shifting the scan from the cathode line $B_1$ in FIG. 1 to the cathode line $B_2$ in FIG. 4, all of the driving switches $6_1$ through $6_{64}$ are turned off, and all of the scanning switches $5_1$ through $5_{64}$ and the shunt switches $7_1$ through $7_{256}$ are switched to 0 V, to shunt all of the anode lines $A_1$ through $A_{256}$ and the cathode lines $B_1$ through $B_{64}$ to 0 V, as shown in FIG. 2. When all are reset to 0 V, all of the anode lines and cathode lines have the same potential of 0 V, so that any electric charge stored or charged in each luminous element is discharged via the routes indicated by arrows in the figure. In this way, the electric charge stored or charged in all of the luminous elements becomes zero instantly. After discharging the electric charge stored in all of the luminous elements to zero as described above, only the scanning switch $5_2$, which corresponds to the cathode line $B_2$, is switched to the side of 0 V to scan the cathode line $B_2$ as shown in FIG. 3. At the same time, only the driving switches $6_2$ and $6_3$ are switched to the side of the current sources $2_2$ and $2_3$ and the shunt switches $7_1$ and $7_4$ through $7_{256}$ are turned on to apply 0 V to the anode lines $A_1$ and $A_4$ through $A_{256}$.

When these switches are switched and the cathode line $B_2$ is scanned, charging currents rush into the luminous elements $E_{2,2}$ and $E_{3,2}$, which are to emit light next, via a plurality of routes as indicated by arrows in FIG. 3. The electric charges stored in all of the luminous elements are zero, as described above, and thus the parasitic capacitors C of the respective luminous elements are instantly charged.

That is, the charging currents flow into the luminous element $E_{2,2}$ via a route of current source $2_2$→driving switch $6_2$→anode line $A_2$→luminous element $E_{2,2}$→scanning switch $5_2$, as well as via a route of scanning switch $5_1$→cathode line $B_1$→luminous element $E_{2,1}$→luminous element $E_{2,2}$→scanning switch $5_2$, via a route of scanning switch $5_3$→cathode line $B_3$→luminous element $E_{2,3}$→luminous element $E_{2,2}$→scanning switch $5_2$, . . . and via a route of scanning switch $5_{64}$→cathode line $B_{64}$→luminous element $E_{2,64}$→luminous element $E_{2,2}$→scanning switch $5_2$, at the same time. In this way, the luminous element $E_{2,2}$ is charged instantly by these plurality of charging currents, and emits light. Then, the state instantly shifts to the stationary state shown in FIG. 4.

Further, the charging currents flow into the luminous element $E_{3,2}$ via a route of current source $2_3$→driving switch $6_3$→anode line $A_3$→luminous element $E_{3,2}$→scanning switch $5_2$, as well as via a route of scanning switch $5_1$→cathode line $B_1$→luminous element $E_{3,1}$→luminous element $E_{3,2}$→scanning switch $5_2$, via a route of scanning switch $5_3$→cathode line $B_3$→luminous element $E_{3,3}$→luminous element $E_{3,2}$→scanning switch $5_2$, . . . and via a route of scanning switch $5_{64}$→cathode line $B_{64}$→luminous element $E_{3,64}$→luminous element $E_{3,2}$→scanning switch $5_2$, at the same time. In this manner, the luminous element $E_{3,2}$ is charged instantly by these plurality of charging currents, and emits light. Then, the state shifts to the stationary state shown in FIG. 4 instantly.

As described above, according to the first driving system, all of the cathode lines and anode lines are connected once to 0 V, i.e., the ground potential, to perform a reset before shifting to the next scan. Thus, when the scan is switched to the next scan line, luminous elements on the switched scan line can emit light instantly.

Although the luminous elements other than the luminous elements $E_{2,2}$ and $E_{3,2}$ are charged via the routes indicated by arrows in FIG. 3, such charging direction is the reverse bias direction, so that there is no possibility that the luminous elements other than the luminous elements $E_{2,2}$ and $E_{3,2}$ will emit light erroneously. Furthermore, although current sources $2_1$ through $2_{256}$ have been used as the driving sources in the example shown in FIGS. 1 through 4, the same effect may be realized also by using voltage sources instead.

FIGS. 5 through 8 show a second driving system of the present invention.

The second driving system corresponds to a case when all of the cathode lines and anode lines are reset once to the source voltage $V_{cc}$=10 V before the next cathode line is scanned. In order to accomplish this resetting method, three-point change-over switches are used as the driving switches $6_1$ through $6_{256}$. In each of these three-point switches, a first contact is opened, a second contact is connected to the current sources $2_1$ through $2_{256}$, and a third contact is connected to the source voltage $V_{cc}$=10 V, respectively, in the circuit shown in FIGS. 5 through 8. Because the portions of the circuit structure other than the driving switches $6_1$ through $6_{256}$ are the same as that of the first driving system described above, the explanation of such other portions will not be repeated here.

Operations for emitting light by means of the second driving system will be explained with reference to FIGS. 5 through 8.

The operations described below are with reference to cases when the luminous elements $E_{1,1}$ and $E_{2,1}$ emit light by scanning the cathode line $B_1$ and, then, the luminous elements $E_{2,2}$ and $E_{3,2}$ emit light by shifting the scan to the cathode line $B_2$ in a manner similar to the first driving system described above.

Figure 5:
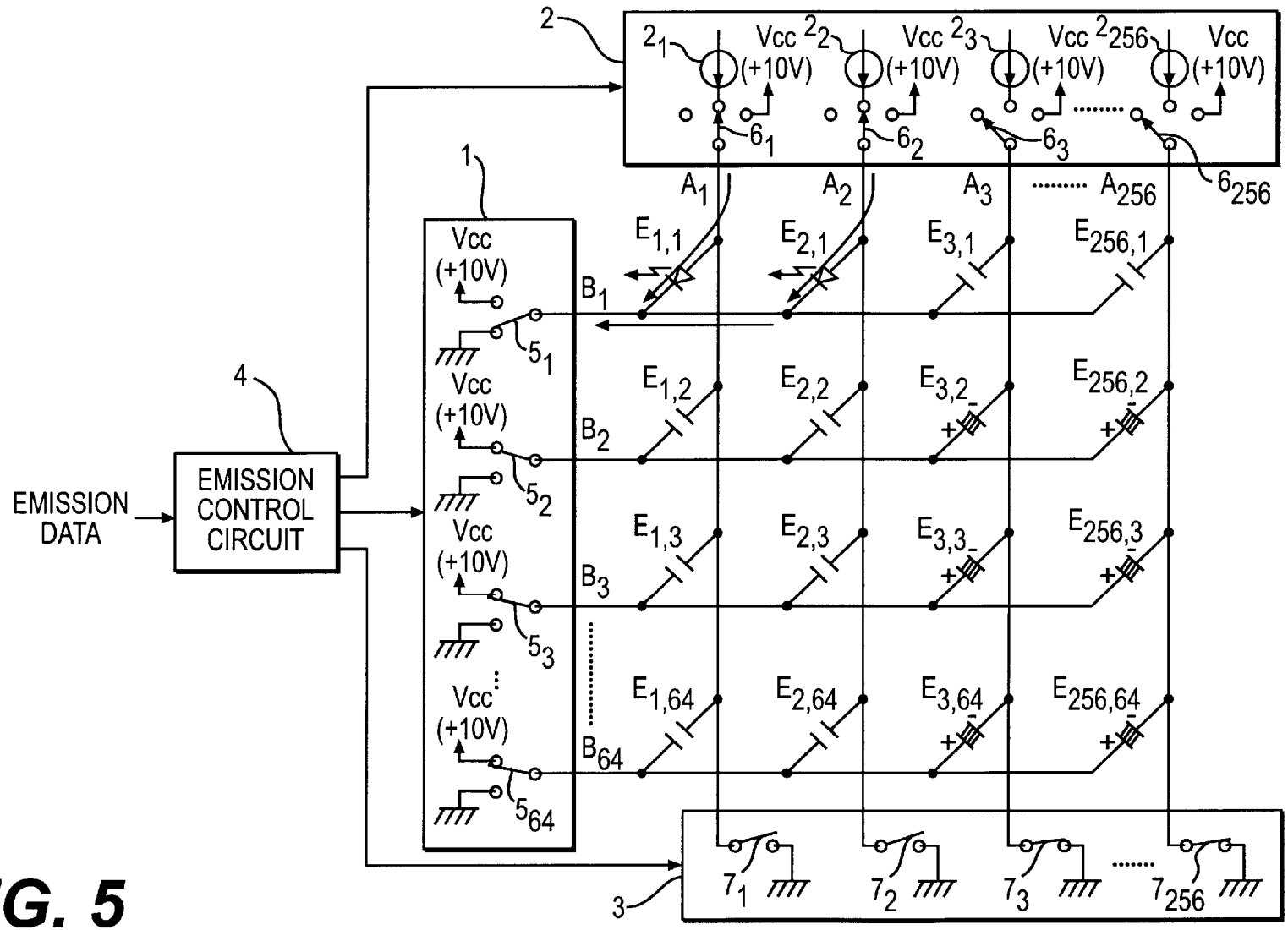
FIG. 5 illustrates a first step of a second driving system of the present invention.

In FIG. 5, the scanning switch $\mathbf{5}_1$ first is switched to 0 V and the cathode line $B_1$ is scanned. The reverse bias voltage of 10 V is applied to the other cathode lines $B_2$ through $B_{64}$ via the scanning switches $\mathbf{5}_2$ through $\mathbf{5}_{64}$. The current sources $\mathbf{2}_1$ and $\mathbf{2}_2$ are connected to the anode lines $A_1$ and $A_2$ via the driving switches $\mathbf{6}_1$ and $\mathbf{6}_2$, 0 V is applied to the other anode lines $A_3$ through $A_{256}$ via the shunt switches $\mathbf{7}_3$ through $\mathbf{7}_{256}$.

As shown in FIG. 5, only the luminous elements $E_{1,1}$ and $E_{2,1}$ emit light because only these elements are biased in the forward direction such that driving currents flow into these elements from the current sources $\mathbf{2}_1$ and $\mathbf{2}_2$ as indicated by arrows in the figure. In FIG. 5, the luminous elements indicated by a hatched capacitor are being charged, in the direction of the polarity shown in the figure. Then, a reset control is carried out by shifting the scan so that a state of emission in which the luminous elements $E_{2,2}$ and $E_{3,2}$ emit light as shown in FIG. 8 is brought about from the state of emission in FIG. 5.

Figure 6:
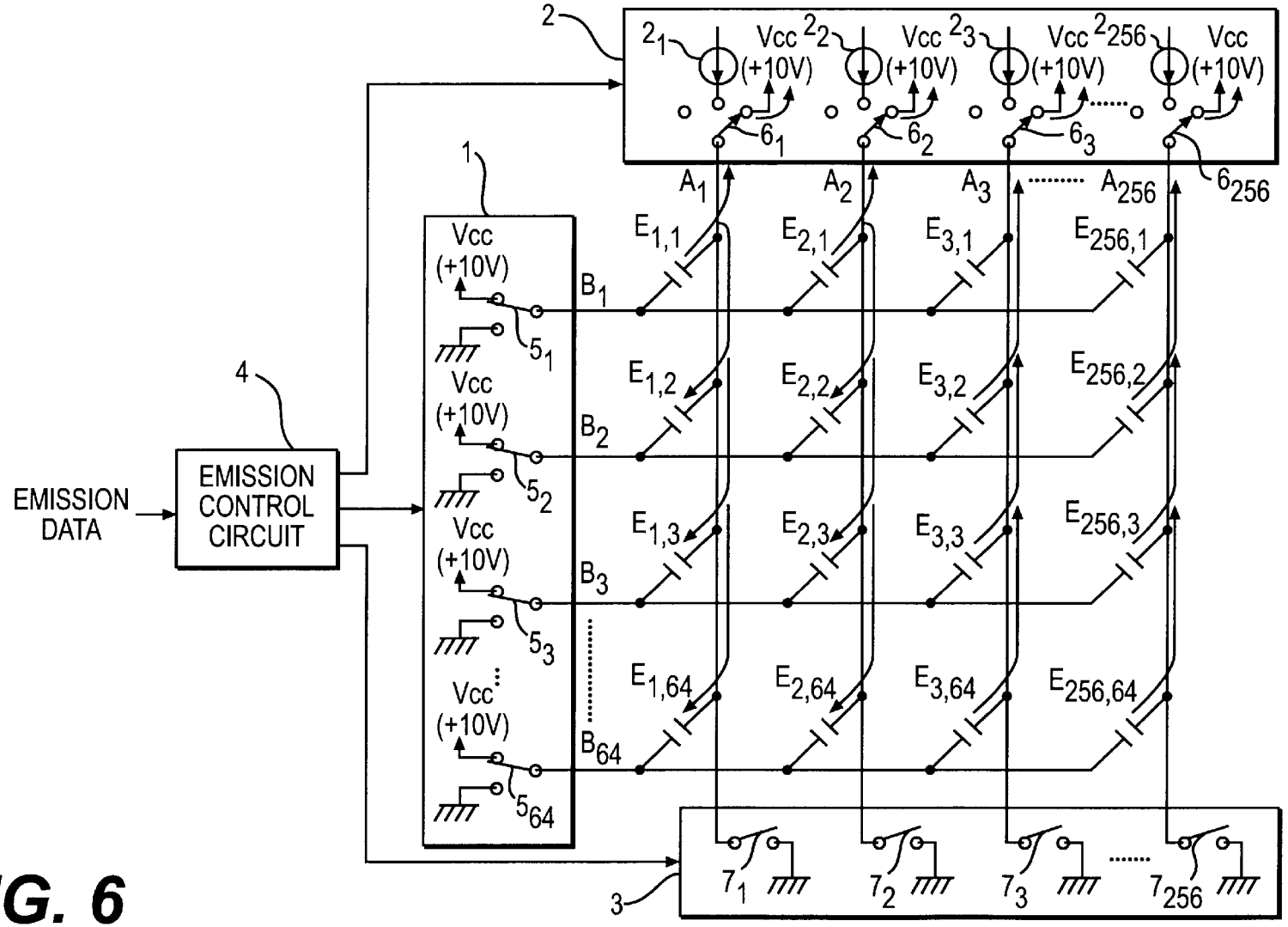
FIG. 6 illustrates a second step of the second driving system of the present invention.
Figure 8:
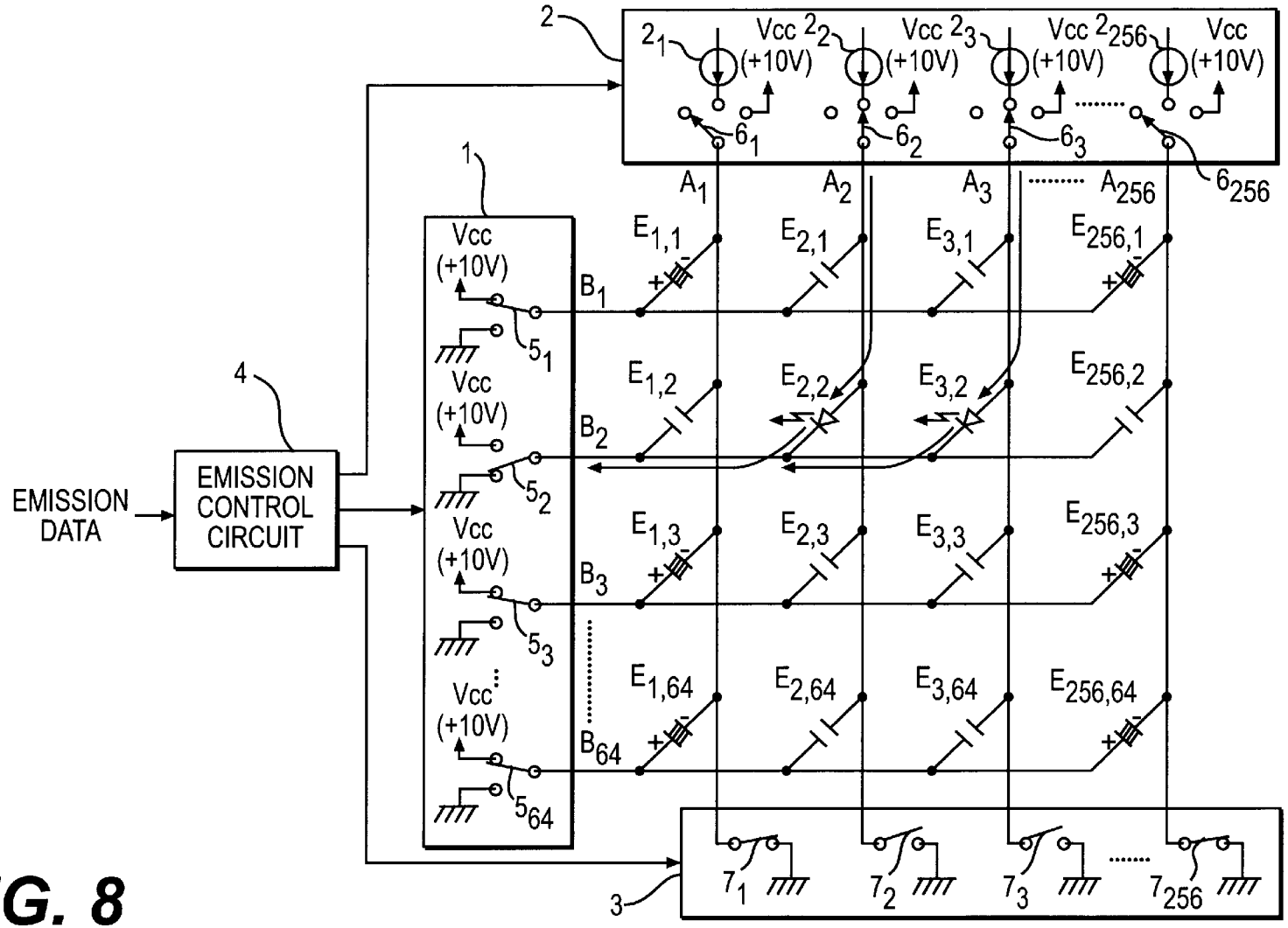
FIG. 8 illustrates a fourth step of the second driving system of the present invention.

Thus, before shifting the scan from the cathode line $B_1$ in FIG. 5 to the cathode line $B_2$ in FIG. 8, all of the shunt switches $\mathbf{7}_1$ through $\mathbf{7}_{256}$ are turned off, and all of the scanning switches $\mathbf{5}_1$ through $\mathbf{5}_{64}$ and the driving switches $\mathbf{6}_1$ through $\mathbf{6}_{256}$ are switched to 10 V, to shunt all of the anode lines $A_1$ through $A_{256}$ and the cathode lines $B_1$ through $B_{64}$ to 10 V once to reset all by 10 V, as shown in FIG. 6. When all are reset to 10 V, all of the anode lines and cathode lines have the same potential of 10 V, so that electric charge stored or charged in each luminous element is discharged via the routes indicated by arrows in the figure. In this way, the electric charge stored or charged in all of the luminous elements becomes zero instantly.

Figure 7:
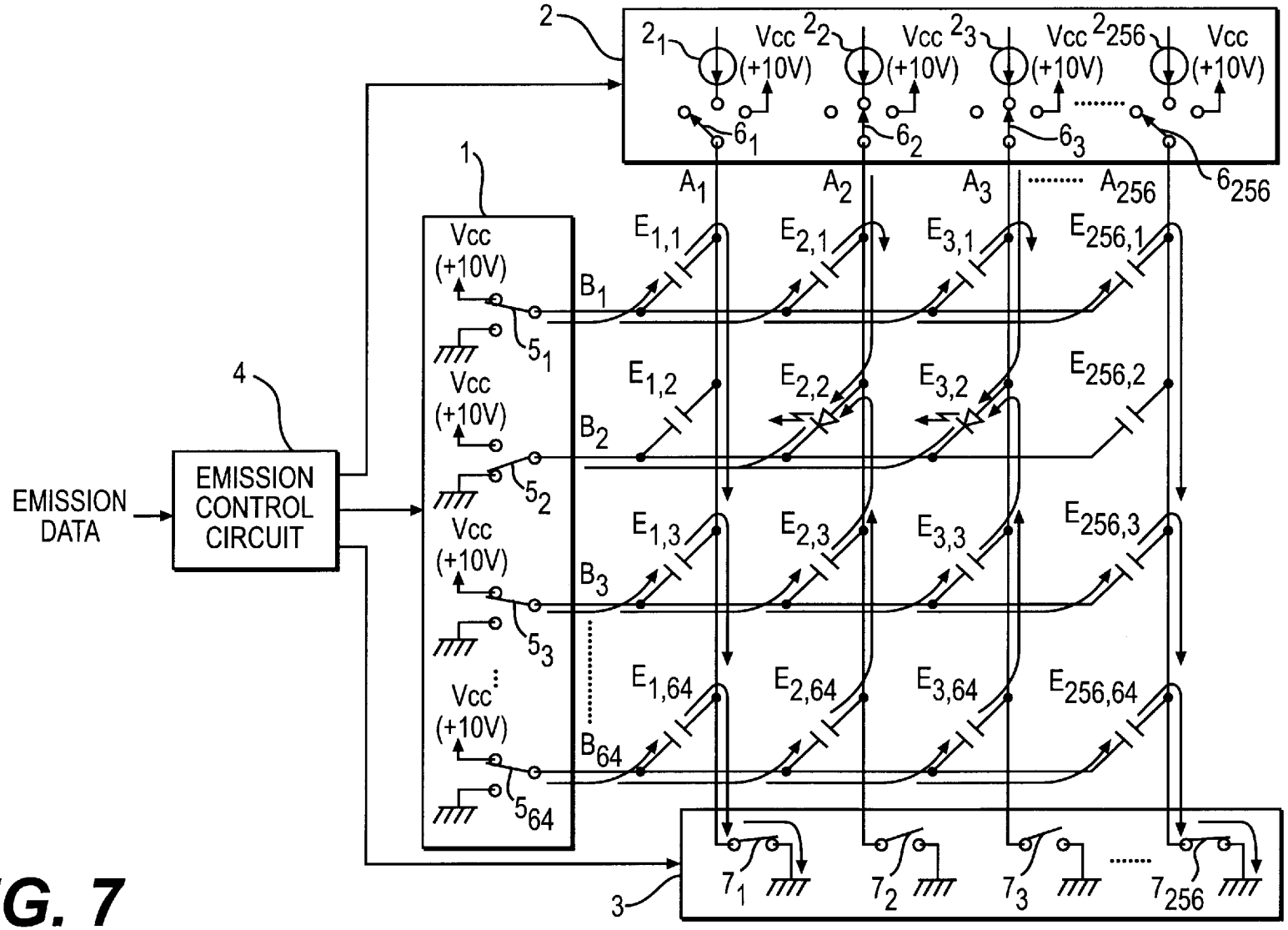
FIG. 7 illustrates a third step of the second driving system of the present invention.

After discharging the electric charge stored in all of the luminous elements to zero, as described above, only the scanning switch $\mathbf{5}_2$ which corresponds to the cathode line $B_2$ is switched to 0 V to scan the cathode line $B_2$, as shown in FIG. 7. At the same time, the driving switches $\mathbf{6}_2$ and $\mathbf{6}_3$ are switched to the side of the current sources $\mathbf{2}_2$ and $\mathbf{2}_3$ and the other driving switches $\mathbf{6}_1$ and $\mathbf{6}_4$ through $\mathbf{6}_{256}$ are switched to the open end side. Further, the shunt switches $\mathbf{7}_1$ and $\mathbf{7}_4$ through $\mathbf{7}_{256}$ are turned on to apply 0 V to the anode lines $A_1$ and $A_4$ through $A_{256}$.

When these switches are switched and the cathode line $B_2$ is scanned, charging currents rush into the luminous elements $E_{2,2}$ and $E_{3,2}$, which are to emit light next, via a plurality of routes as indicated by arrows in FIG. 7. The electric charges stored in all of the luminous elements are zero, as described above, and thus the parasitic capacitors C of the respective luminous elements are charged instantly.

That is, the charging currents flow into the luminous element $E_{2,2}$ via a route of current source $\mathbf{2}_2$→driving switch $\mathbf{6}_2$→anode line $A_2$→luminous element $E_{2,2}$→scanning switch $\mathbf{5}_2$, as well as via a route of scanning switch $\mathbf{5}_1$→cathode line $B_1$→luminous element $E_{2,1}$→luminous element $E_{2,2}$→scanning switch $\mathbf{5}_2$, via a route of scanning switch $\mathbf{5}_3$→cathode line $B_3$→luminous element $E_{2,3}$→luminous element $E_{2,2}$→scanning switch $\mathbf{5}_2$, . . . and via a route of scanning switch $\mathbf{5}_{64}$→cathode line $B_{64}$→luminous element $E_{2,64}$→luminous element $E_{2,2}$→scanning switch $\mathbf{5}_2$, at the same time. In this way, the luminous element $E_{2,2}$ is charged instantly by these plurality of charging currents, and emits light. Then, the state instantly shifts to the stationary state shown in FIG. 8.

Further, the charging currents flow into the luminous element $E_{3,2}$ via a route of current source $\mathbf{2}_3$→driving switch $\mathbf{6}_3$→anode line $A_3$→luminous element $E_{3,2}$→scanning switch $\mathbf{5}_2$, as well as via a route of scanning switch $\mathbf{5}_1$→cathode line $B_1$→luminous element $E_{3,1}$→luminous element $E_{3,2}$→scanning switch $\mathbf{5}_2$, via a route of scanning switch $\mathbf{5}_3$→cathode line $B_3$→luminous element $E_{3,3}$→luminous element $E_{3,2}$→scanning switch $\mathbf{5}_2$ . . . and via a route of scanning switch $\mathbf{5}_{64}$→cathode line $B_{64}$→luminous element $E_{3,64}$→luminous element $E_{3,2}$→scanning switch $\mathbf{5}_2$, at the same time. In this manner, the luminous element $E_{3,2}$ is charged instantly by these plurality of charging currents, and emits light. Then, the state instantly shifts to the stationary state shown in FIG. 8.

As described above, according to the second driving system, all of the cathode lines and anode lines are connected once to 10 V, i.e., the source voltage, to perform a reset before shifting to the next scan, so that when the scan is switched to the next scan line, luminous elements on the switched scan line can emit light instantly.

Although the luminous elements other than the luminous elements $E_{2,2}$ and $E_{3,2}$ to emit light are charged, respectively, via routes as indicated by arrows in FIG. 7, such charging direction is the reverse bias direction, so that there is no possibility that the other luminous elements will emit erroneously.

Although the current sources $\mathbf{2}_1$ through $\mathbf{2}_{256}$ have been used as the driving sources in the example shown in FIGS. 5 through 8, the same effect may be realized also by using voltage sources instead.

FIGS. 9 through 12 show a third driving system of the present invention.

The third driving system corresponds to a case when all of the cathode lines $B_1$ through $B_{64}$ are reset to 10 V, and the anode lines $A_1$ through $A_{256}$ are preset, in order to be ready for the next emission before the next cathode line is scanned. Because the circuit structure itself is the same as that of the second driving system described above, explanation of such structure will not be repeated here.

Operations for emitting light by means of the third driving system will be explained with reference to FIGS. 9 through 12.

The operations described below are with reference to cases when the luminous elements $E_{1,1}$ and $E_{2,1}$ emit light by scanning the cathode line $B_1$ and then the luminous elements $E_{2,2}$ and $E_{3,2}$ emit light by shifting the scan to the cathode line $B_2$ in a manner similar to the first and second driving systems described above.

Figure 9:
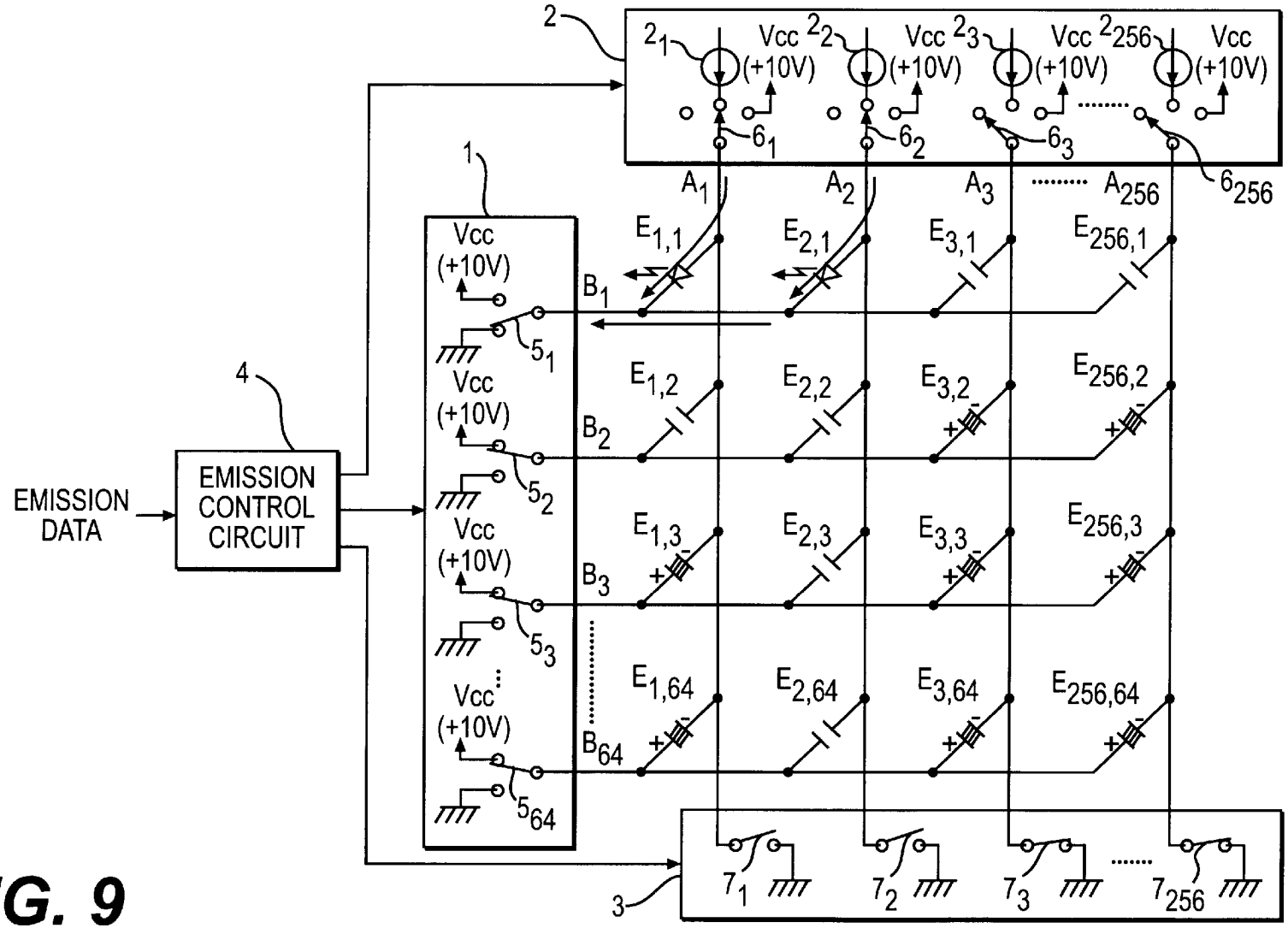
FIG. 9 illustrates a first step of a third driving system of the present invention.

In FIG. 9, the scanning switch $\mathbf{5}_1$ is first switched to 0 V and the cathode line $B_1$ is scanned. The reverse bias voltage of 10 V is applied to the other cathode lines $B_2$ through $B_{64}$ via the scanning switches $\mathbf{5}_2$ through $\mathbf{5}_{64}$. The current sources $\mathbf{2}_1$ and $\mathbf{2}_2$ are connected to the anode lines $A_1$ and $A_2$ via the driving switches $\mathbf{6}_1$ and $_2$, and 0 V is applied to the other anode lines $A_3$ through $A_{256}$ via the shunt switches $\mathbf{7}_3$ through $\mathbf{7}_{256}$.

As shown in FIG. 9, only the luminous elements $E_{1,1}$ and $E_{2,1}$ emit light because only these elements are biased in the forward direction such that driving currents flow into these elements from the current sources $\mathbf{2}_1$ and $\mathbf{2}_2$ as indicated by the arrows in the figure. FIG. 9, the luminous elements indicated by a hatched capacitor are being charged in the direction of the polarity shown in the figure. Then, a reset control is carried out by shifting the scan so that a state of emission in which the luminous elements $E_{2,2}$ and $E_{3,2}$ emit light as shown in FIG. 12 is brought about from the state of emission in FIG. 9.

Figure 10:
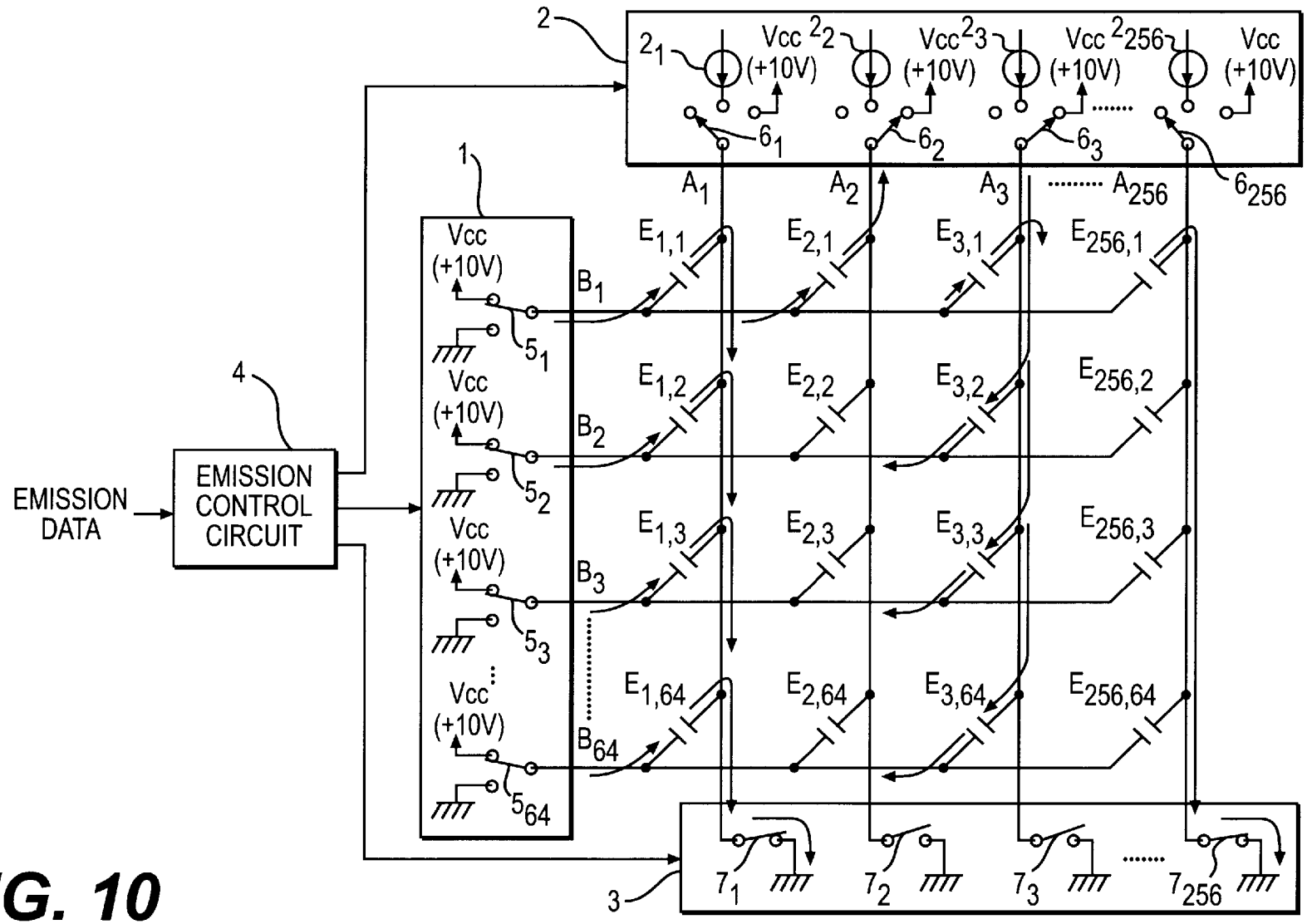
FIG. 10 illustrates a second step of the third driving system of the present invention.
Figure 12:
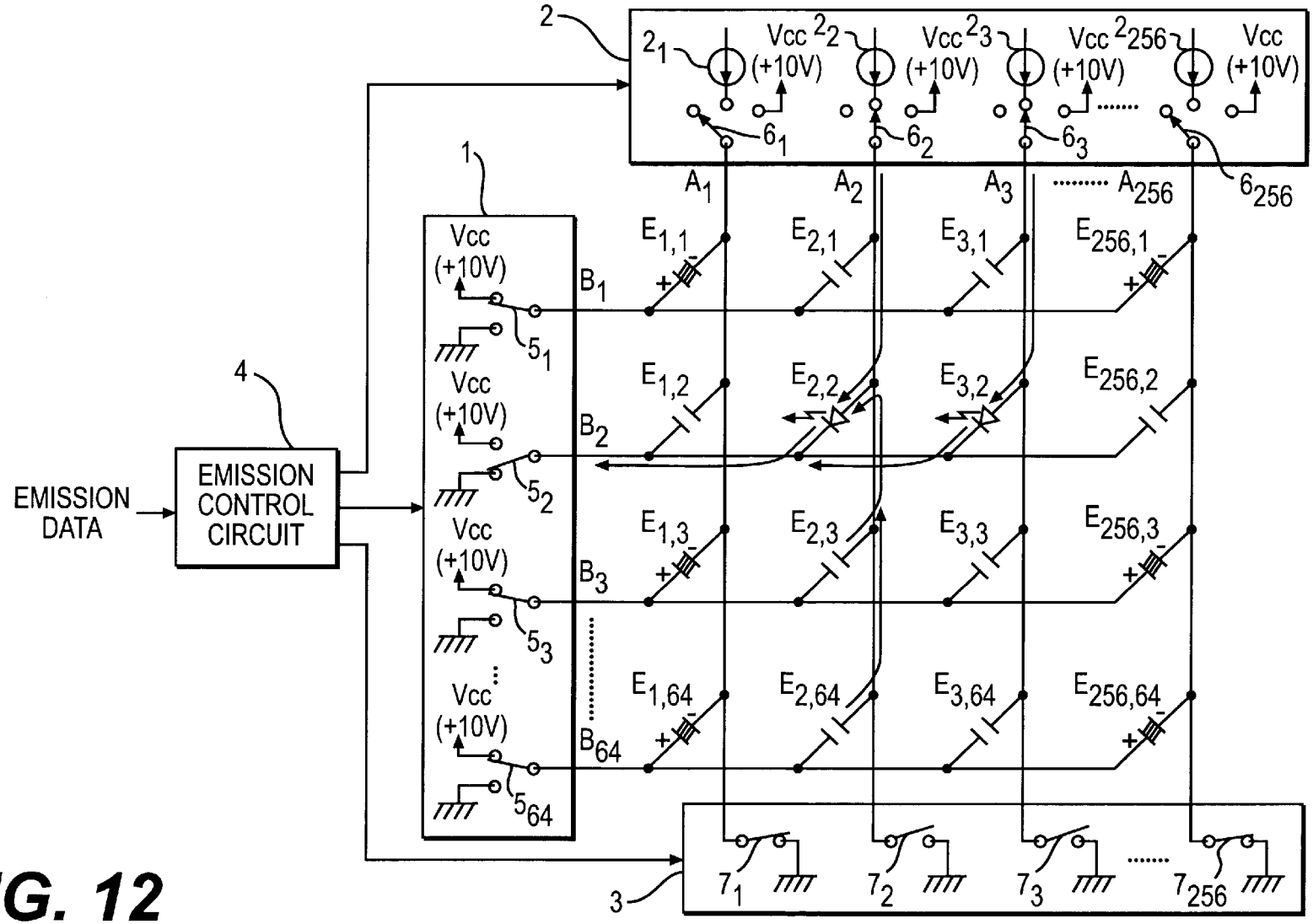
FIG. 12 illustrates a fourth step of the third driving system of the present invention.
Figure 14:
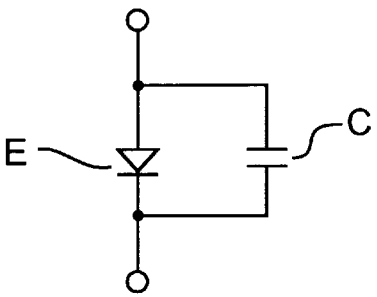
FIG. 14 illustrates an equivalent circuit of a luminous element.
Figure 13:
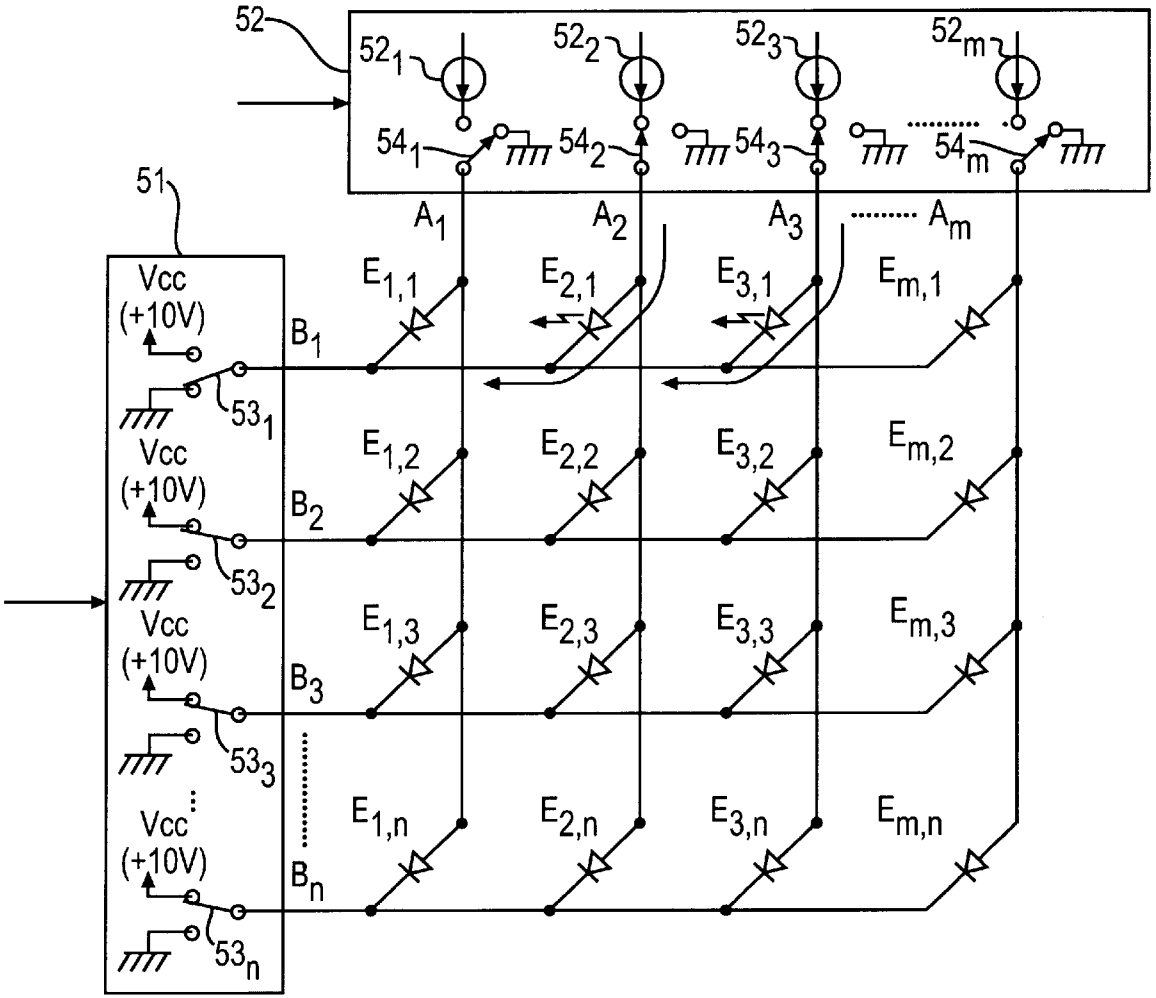
FIG. 13 illustrates a prior art driving system.
Figure 15A:
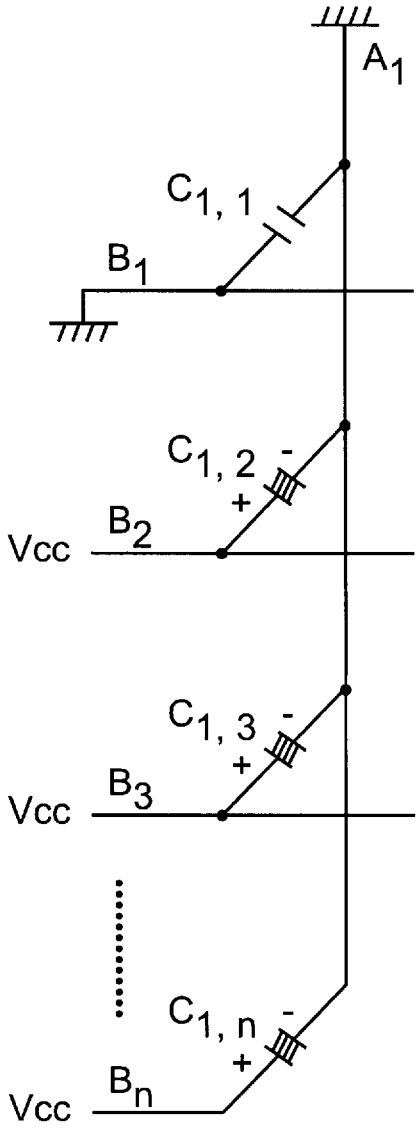
FIGS. 15A and 15B illustrate charging/discharging states in shifting scans in the prior art driving system.
Figure 15B:
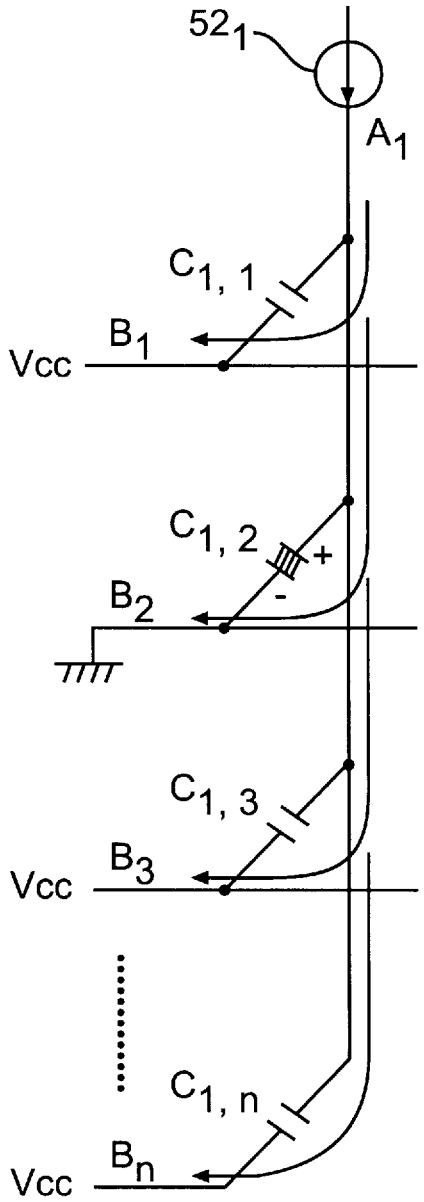

Thus, before shifting the scan from the cathode line $B_1$ in FIG. 9 to the cathode line $B_2$ in FIG. 12, all of the scanning switches $5_1$ through $5_{64}$ are switched to 10 V to reset all as shown in FIG. 10. Further, for the anode lines, only the driving switches $6_2$ and $6_3$, which correspond to the luminous elements $E_{2,2}$ and $E_{2,3}$ that emit light, are connected to 10 V for preset, and the other driving switches $6_1$ and $6_4$ through $6_{256}$ are connected to the open end side. Further, the shunt switches $7_1$and $7_4$ through $7_{256}$ are turned on to achieve connection to 0 V.

When all of the cathode lines $B_1$ through $B_{64}$ are reset to 10 V and the anode lines $A_2$ and $A_3$ are preset to the source voltage of 10 V, electric charge stored or charged in each luminous element is charged/discharged via the routes indicated by arrows in the figure. In this way, the electric charge stored in each of the luminous elements $E_{2,1}$ through $E_{2,64}$ and $E_{3,1}$ through $E_{3,64}$, connected to the anode lines $A_2$ and $A_3$, which are to be caused to emit light, becomes zero instantly.

Figure 11:
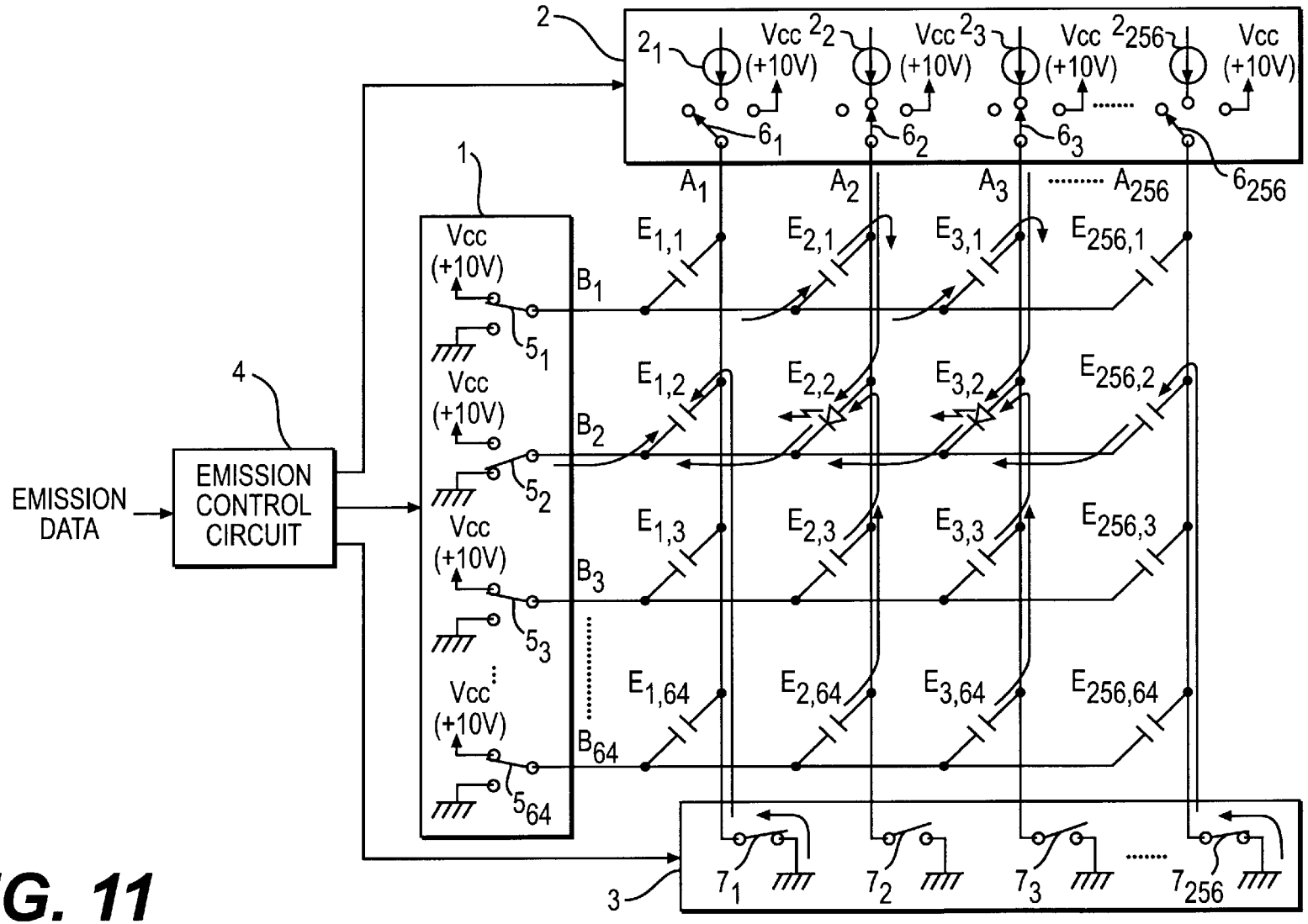
FIG. 11 illustrates a third step of the third driving system of the present invention.

After discharging the electric charge stored in each of the luminous elements $E_{2,1}$ through $E_{2,64}$ and $E_{3,1}$ through $E_{3,64}$ to zero as described above, the scanning switch $5_2$ is switched to of 0 V to scan the cathode line $B_2$ as shown in FIG. 11. At the same time, the driving switches $6_2$ and $6_3$ are switched to the side of the current sources $2_2$ and $2_3$.

When these switches are switched and the cathode line $B_2$ is scanned, charging currents rush into the luminous elements $E_{2,2}$ and $E_{3,2}$, which are to emit light, via a plurality of routes as indicated by arrows in FIG. 11, thus charging the parasitic capacitor C of the respective luminous elements instantly.

That is, the charging currents flow into the luminous element $E_{2,2}$ via a route of current source $2_2$→driving switch $6_2$→anode line $A_2$→luminous element $E_{2,2}$→scanning switch $5_2$, as well as via a route of scanning switch $5_1$→cathode line $B_1$→luminous element $E_{2,1}$ →luminous element $E_{2,2}$→scanning switch $5_2$, via a route of scanning switch $5_3$→cathode line $B_3$→luminous element $E_{2,3}$→luminous element $E_{2,2}$→scanning switch $5_2$, . . . and via a route of scanning switch $5_{64}$→cathode line $B_{64}$→luminous element $E_{2,64}$→luminous element $E_{2,2}$→scanning switch $5_2$, at the same time. In this way, the luminous element $E_{2,2}$ is charged instantly by these plurality of charging currents, and emits light. Then, the state shifts to the stationary state shown in FIG. 12 instantly.

Further, the charging currents flow into the luminous element $E_{3,2}$ via a route of current source $2_3$→driving switch $6_3$→anode line $A_3$→luminous element $E_{3,2}$→scanning switch $5_2$, as well as via a route of scanning switch $5_1$→cathode line $B_1$→luminous element $E_{3,1}$→luminous element $E_{3,2}$→scanning switch $5_2$, via a route of scanning switch $5_3$→cathode line $B_3$→luminous element $E_{3,3}$→luminous element $E_{3,2}$→scanning switch $5_2$, . . . and via a route of scanning switch $5_{64}$→cathode line $B_{64}$→luminous element $E_{3,64}$→luminous element $E_{3,2}$→scanning switch $5_2$, at the same time. In this manner, the luminous element $E_{3,2}$ is charged instantly by these plurality of charging currents, and emits light. Then, the state shifts to the stationary state shown in FIG. 12 instantly.

As described above, according to the third driving system, all of the cathode lines are reset to 10 V and the anode lines are preset to be ready for the next emission before shifting to the next scan, so that when the scan is switched to the next scan line, luminous elements on the switched scan line can emit light instantly.

Although the luminous elements other than the luminous elements $E_{2,2}$ and $E_{3,2}$ are charged via routes as indicated by arrows in FIG. 11, such charging direction is the reverse bias direction, so that there is no possibility that luminous elements other than the luminous elements $E_{2,2}$ and $E_{3,2}$ will emit light erroneously.

Although all of the cathode lines have been reset to 10 V in the third driving system described above, all of the cathode lines may instead be reset to 0 V. Further, although current sources $2_1$ through $2_{256}$ have been used as the driving sources in the example shown in FIGS. 9 through 12, the same effect may be realized by using voltage sources instead.

As is apparent with reference to each figure of FIGS. 3, 7 and 10 described above, the luminous elements $E_{2,2}$ and $E_{3,2}$ are charged not only from the current sources $2_2$ and $2_3$, but also from the other luminous elements connected to the anode lines $A_2$ and $A_3$ at the same time via the cathode lines $B_1$ and $B_3$ through $B_{64}$ to which the reverse bias voltage is applied.

Therefore, when a large number of luminous elements are connected to the anode lines, the luminous elements $E_{2,2}$ and $E_{3,2}$ may emit light just by the charging current obtained via those other luminous elements, if for a short time. Accordingly, the current sources $2_1$ through $2_{256}$ of the anode line driving circuit 2 may be obviated by scanning the cathode lines with a period shorter than a duration of the emission caused by the charging current obtained via the other luminous elements.

Further, although the embodiments described above have been explained in connection with examples exemplifying the system of scanning cathode lines and driving anode lines, the same invention may be realized by scanning anode lines and driving cathode lines.

As described above, according to the present invention, the parasitic capacitors of luminous elements to emit light are charged by the driving sources via the drive lines and also by the reverse bias voltage of the scan lines at the same time via the parasitic capacitors of the other luminous elements not emitting. This is accomplished by switching the scanning position to the next scan line after resetting all of the scan lines, so that an end-to-end voltage of the luminous elements to emit light may be built up instantly to a voltage which allows the emission, thus allowing the luminous elements to emit light instantly. Further, because the charge obtained via the other luminous elements is utilized, the capacity of each driving source may be reduced and the driving unit can be miniaturized.

Moreover, the driving unit is adapted to be able to emit light quickly while eliminating all of the driving sources on the drive line side, so that the driving unit may be further simplified and miniaturized.

It will be apparent to those skilled in the art that various modifications and variations can be made in the driving system of the present invention without departing from the spirit or scope of the invention. Thus, it is intended that the present invention cover the modifications and variations of this invention provided they come within the scope of the appended claims and their equivalents.

What is claimed is:

1. A driving system for driving luminous elements, the driving system comprising:

a plurality of intersecting anode and cathode lines arranged in a matrix, the anode lines being one of scan lines and drive lines, and the cathode lines being one of other of scan lines and drive lines;

a plurality of luminous elements, each of the luminous elements being coupled to one of the scan lines and one of the drive lines at a point where the scan and drive lines intersect, and control circuitry for causing at least one of the luminous elements to emit light by executing scanning of at least one of the scan lines and, during a predetermined period of the scanning, by coupling a driving source to at least one of the drive lines in synchronism with the scanning, the control circuitry resetting the scan lines before switching to a subsequent scan line by coupling each of the scan lines to a same reset voltage potential.

2. The driving system for driving luminous elements according to claim 1, wherein the reset voltage potential is a ground potential.

3. The driving system for driving luminous elements according to claim 1, wherein the reset voltage potential is a supply potential.

4. The driving system for driving luminous elements according to claim 1, wherein the resetting function performed by the control circuitry is performed without use of any drive line drive source.

5. The driving system for driving luminous elements according to claim 2, wherein the resetting function performed by the control circuitry is performed without use of any drive line drive source.

6. The driving system for driving luminous elements according to claim 3, wherein the resetting function performed by the control circuitry is performed without use of any drive line drive source.

7. The driving system for driving luminous elements according to claim 1, wherein the control circuitry resets all of the scan lines before switching to each subsequent scan line by simultaneously coupling each of the scan lines to the same reset voltage potential.

8. The driving system for driving luminous elements according to claim 1, wherein the luminous elements are organic electroluminescense elements.

9. The driving system for driving luminous elements according to claim 1, wherein the control circuitry comprises a line scanning circuit for scanning the scan lines, and a line driving circuit for driving the drive lines.

10. The driving system for driving luminous elements according to claim 7, wherein the line driving circuit comprises a plurality of current sources each for driving a different one of the drive lines.

11. The driving system for driving luminous elements according to claim 7, wherein the line driving circuit comprises a plurality of voltage sources each for driving a different one of the drive lines.

12. The driving system for driving luminous elements according to claim 7, wherein the line scanning circuit applies a ground potential to each scan line being scanned and a reverse bias voltage to each scanning line not being scanned.

13. The driving system for driving luminous elements according to claim 7, further comprising a drive line resetting circuit including shunt switches for resetting the drive lines to a ground potential.

14. A method of driving luminous elements in a driving system comprising a plurality of intersecting anode and cathode lines arranged in a matrix, the anode lines being one of scan lines and drive lines, and the cathode lines being one of other of scan lines and drive lines; a plurality of luminous elements, each of the luminous elements being coupled to one of the scan lines and one of the drive lines at a point where the scan and drive lines intersect; and control circuitry for causing at least one of the luminous elements to emit light; the method comprising the steps, performed using the control circuitry, of:

scanning at least one of the scan lines;

driving at least one of the drive lines in synchronism with the scanning; and resetting the scan lines before switching to a subsequent scan line by coupling each of the scan lines to a same reset voltage potential.

15. The method according to claim 12, wherein the resetting step comprises:

simultaneously coupling each of the scan lines to the same reset voltage potential.

16. The method according to claim 12, wherein the resetting step comprises:

coupling all of the scan lines to a same ground potential;

turning off all drive sources coupled to one end of the drive lines; and shunting the other end of the drive lines to a same ground potential.

17. The method according to claim 12, wherein the resetting step comprises:

coupling all of the scan lines to a same source potential;

coupling one end of each of the drive lines to a same source potential; and shunting the other end of the drive lines to a same ground potential.

18. The method according to claim 12, wherein the resetting step comprises:

coupling all of the scan lines to a same source potential;

turning off only selected ones of drive sources coupled to one end of the drive lines; and shunting the other end of the drive lines to a same ground potential.

* * * * *